United States Patent [19]

Enright

[11] Patent Number: 4,858,674

[45] Date of Patent: Aug. 22, 1989

[54] CASTING ALUMINIUM ALLOYS

[75] Inventor: Philip G. Enright, Oxfordshire, England

[73] Assignee: Alcan International Limited, Montreal, Canada

[21] Appl. No.: 83,941

[22] Filed: Jul. 28, 1987

Related U.S. Application Data

[63] Continuation of Ser. No. 838,428, Mar. 10, 1986, abandoned, which is a continuation of Ser. No. 540,202, Oct. 7, 1983, abandoned.

[30] Foreign Application Priority Data

Oct. 15, 1982 [GB] United Kingdom ..... 8229602

[51] Int. Cl.[4] ..... B22D 11/00

[52] U.S. Cl. ..... 164/475; 164/473

[58] Field of Search ..... 164/475, 459, 473

[56] References Cited

U.S. PATENT DOCUMENTS

| | | | |
|---|---|---|---|
| 3,746,070 | 7/1973 | Hill | 164/473 |
| 4,157,728 | 6/1979 | Mitamura et al. | 164/472 |
| 4,273,180 | 6/1981 | Tertishniker et al. | 164/475 |
| 4,355,679 | 10/1982 | Wilkins | 164/475 |

FOREIGN PATENT DOCUMENTS

| | | | |
|---|---|---|---|
| 2518903 | 3/1976 | Fed. Rep. of Germany | 164/459 |
| 410301 | 2/1966 | Switzerland | 164/82 |
| 725788 | 11/1980 | U.S.S.R. | 164/473 |

OTHER PUBLICATIONS

American Society for Metals "Forging and Casting Handbook", 8th ed., pp. 396 & 397.

*Primary Examiner*—Richard K. Seidel

*Attorney, Agent, or Firm*—Cooper & Dunham

[57] ABSTRACT

In the casting of ingots of aluminium alloys, containing a readily oxidizable component, in an open-ended mould, a space is enclosed over the molten metal surface adjacent the mould wall and is filled with an inert gas. The enclosure is maintained by a baffle which dips into the molten metal surface close to the baffle. The molten metal surface between the baffle and the mould wall is preferably covered by a layer of an oxide-dissolving flux, which cleanses the meniscus at the metal meniscus/mould wall interface.

7 Claims, 1 Drawing Sheet

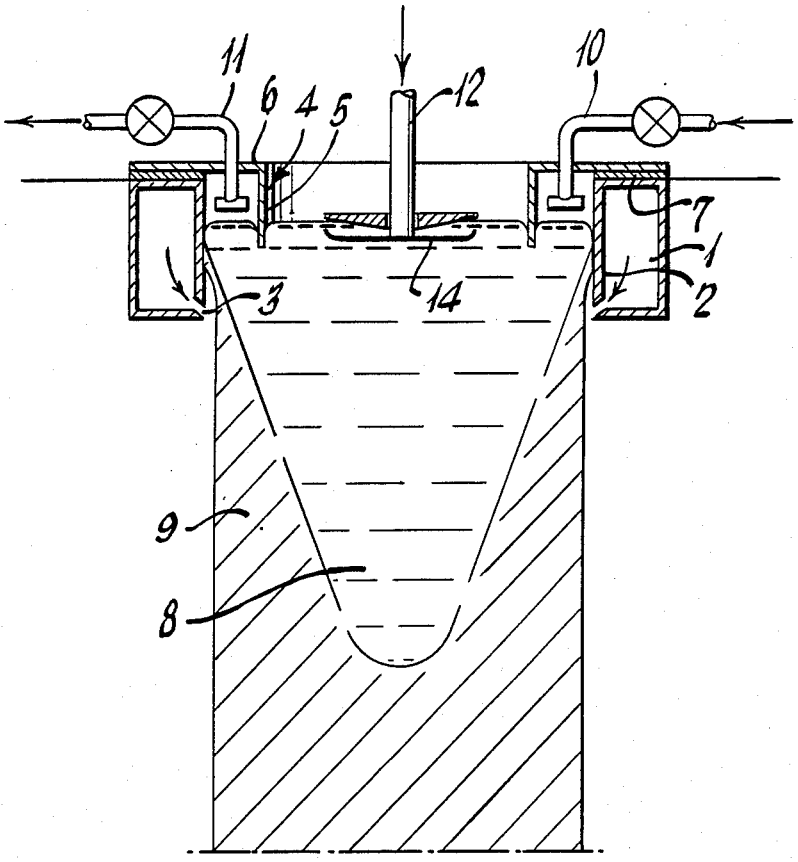
11
6
4
5
12
10
7
1
2
3
14
9
8

CASTING ALUMINIUM ALLOYS

This is a continuation of application Ser. No. 838,428, now abandoned, filed Mar. 10, 1986, which is a continuation of Ser. No. 540,202 filed Oct. 7, 1983, now abandoned.

The present invention relates to casting aluminium (including aluminium alloys) in ingot form. In particular it relates to improvements in methods and apparatus for the casting of aluminium by the vertical D.C. (direct chill) casting process and similar casting procedures, in which molten aluminium is cast in a stationary open-ended mould.

In the vertical D.C. casting process aluminium is poured into an open-ended mould, in which a solidified skin is formed at the point of contact of the molten metal with the chilled surface of the mould and coolant is applied to the solidified surface of the ingot as it issues from the bottom end of the mould.

As a result of intensive development of the D.C. casting process over many years, it is today possible to produce round or rectangular-section ingot with relatively smooth surfaces in most aluminium alloys. Formerly such ingots frequently had very rough surfaces and it was necessary to scalp off a considerable thickness of the ingot surface. While that problem has largely been overcome when casting most aluminium alloys, it still remains in the casting of various aluminium alloys, particularly alloys having high contents of readily oxidisable constituents and wide freezing range.

It is an object of the present invention to provide an improved method and apparatus for performing the D.C. casting process and similar casting processes to obtain a smoother surface on certain difficult aluminium alloys.

As a result of studies of the peripheral surfaces of ingots of alloys which have proved difficult to cast with smooth surfaces, we have found that in some instances surface imperfections, resulting from the general solidification mode in the vicinity of the metal meniscus/-mould interface, are accentuated by the formation of surface oxides or other reaction products formed in and near to the same region. Additionally, surface oxides may be dragged down between the surface of the growing ingot and the mould wall and, where these oxides are of a hard crystalline nature, may cause vertical folding of the soft, partially-solidified skin, resulting in unacceptable surface defects or even subsequent ingot cracking.

We have found that this difficulty may be largely overcome by maintaining an essentially inert gas atmosphere in an enclosed space at the peripheral region over the molten metal at the mould wall, the enclosed space being essentially sealed off from the central region. The maintenance of such an atmosphere in the enclosed space at the peripheral region is most conveniently achieved by locating a baffle at a predetermined distance from the mould wall at a position where its lower edge will dip into molten metal during a casting operation, so as to check gas flow through the metal into the central region. Inlet and outlet connections are provided to permit passage of a stream of inert gas through the thus enclosed space and the pressure within such space is preferably maintained close to the ambient atmosphere pressure. The central region within the edge baffle is very conveniently left open to atmosphere for visibility by the operator, who can thus assure himself that the metal within the mould has not accidentally dropped to a hazardously low level; at the same time, the control of oxidation at the metal meniscus/mould interface results in the stable conditions required for the production of a smooth-surfaced ingot.

In some instances it may be desirable to change the shape of the metal meniscus adjacent the mould wall by maintaining superatmospheric or subatmospheric pressure within the enclosed space. In such event the pressure in the enclosed space must be held at such a value that the flow of gas between the ingot and the mould wall is held down to an essentially negligible value.

Since it is very difficult to avoid some entry of air into the enclosed peripheral region in the circumstances of a metal casting operation, it is frequently desirable to maintain a oxide-dissolving flux cover over the surface of the molten metal in the peripheral region, even though, theoretically, the inert atmosphere should suffice to protect the metal against the formation of oxides.

The desirability of maintaining a flux cover over the molten metal surface is dependent upon the oxidisable components in the alloy. Where, for instance, the oxidisable component is magnesium, it may be unnnecessary to provide a flux over the central region of the molten metal surface and it is frequently sufficient to shield the peripheral region by means of inert gas without also employing a flux. It may however be preferred to provide a flux at least within the enclosed peripheral region to obtain optimum results. However with an alloy containing a more highly oxidisable component, such as lithium, it is preferred to maintain a flux both over the exposed molten metal surface and over the inert gas-shielded peripheral region. The flux in the peripheral region particularly serves to cleanse the mould wall at the level of the metal meniscus. For this reason the edge baffle may be arranged for controlled vertical movement. In those instances where a halide-type flux is established on the molten metal surface in the central region within the baffle, the flux may be introduced into the enclosed space between the baffle and the mould wall by raising the baffle briefly to allow the molten flux to flow outwardly over the surface of the molten melt and then lowering the baffle to re-establish the enclosure of the peripheral region. In some cases the flux may be formed in situ within the enclosed space by introducing a halogen gas with the inert gas into the enclosed space for reaction with a component of the alloy to form the flux. This allows a supplementary quantity of flux to be generated within the enclosed region as the casting operation proceeds.

According to a further feature of the invention the shape of the metal meniscus adjacent the mould wall may be controlled by maintaining a restricted gap between the baffle and the mould wall. Where it is desired to effect a controlling effect in that way the distance between the mould wall and the baffle is normally arranged in the range of 5 to 20 mm.

It has already been proposed in U.S. Pat. No. 4,157,728 to cast molten aluminium via a vertical D.C. casting mould, to which molten metal is supplied through a thermally insulated reservoir, which has an internal diameter, somewhat less than that of the mould. Such reservoirs are commonly known in the aluminium industry as "hot tops". The advantage of the hot top system is that it maintains the position of the contact between the molten metal and the mould at a substantially constant level. However, where a hot top is employed, any variation in the head of molten metal in the hot top has a modifying effect on the shape of the meniscus adjacent the molten metal/mould wall interface. In the said U.S. Patent gas (which may be air or inert gas) is admitted under pressure beneath the overhanging portion of the hot top at the entrance to the mould and simultaneously lubricant is injected at the same location.

The gas pressure admitted was preferably sufficient to effect approximate balance of the hydrostatic head of metal in the hot top and it was intended that there should be no flow of air bubbles up through the hot top. The process appears to rely upon a very close control of the air pressure and gas flow rate with the air escaping downwardly between the periphery of the ingot and the mould. The application of air pressure has a substantial effect in lowering the level at which there is contact between the metal and the mould and thus air pressure has the effect of imposing a substantial change on the shape of the metal meniscus. A process of this type seems likely to lead to instability of the meniscus because of the possibility of air escape being through accidental preferential channels at the metal/mould interface.

The downward passage of air currents or bubbles at the mould/metal interface would be highly undesirable for the class of alloys with which the present invention is primarily involved, since this would seem likely to lead to the formation of highly undesirable defects at the metal/mould interface, with consequent vertical marks on the ingot surface.

In the system of the U.S. Patent there is a line of contact between molten metal and the bottom end of the hot top at a level above the level at which the molten metal contacts the mould wall.

By contrast in the system of the present invention the bottom edge of the baffle dips into the molten metal, so that, due to surface effects, there is some upward convexity of the molten metal within the enclosed space at the outer side of the baffle.

The baffle serves only to seal off the peripheral region of the upper surface of the molten metal from the central region and therefore the edge of the baffle need only dip into the molten metal to a very slight extent. However to simplify the casting operation and to avoid loss of the seal in the event of a minor variation in metal level, the bottom edge of the baffle is preferably arranged to be at a level below the level at which molten metal contacts the mould surface.

In the procedure of the present invention there is essentially no inert gas flow downwardly at the metal/mould interface or escape of gas around the edge of the baffle. A steady flow of inert gas is maintained through the enclosed space to maintain essentially oxygen-free conditions within such enclosed space. Shape of the meniscus in the vicinity of the metal/mould interface is controlled by the spacing between the baffle and the mould wall and the extent to which the baffle dips into the metal. Where a hot top is employed, requiring a positive pressure of inert gas within the enclosed space, the baffle is positioned so as to dip downwardly into the molten metal below the hot top and thus at its lower extremity it extends downwardly inside the mould. The baffle may be formed integrally with the hot top in some instances. Gas is released from the enclosed space through a pressure control valve set at a release pressure equal to the pressure head of the metal in the hot top so that the operation is essentially unchanged. However the present invention finds its principle utility in casting operations in which the molten metal surface in the enclosed space is at a level very close to the molten metal level in the central region within the baffle.

One form of apparatus for putting the invention into effect is illustrated in the accompanying drawing.

The metal is cast in a conventional direct chill mould 1, which has a water cooled mould wall 2 and a continuous slit 3 for application of coolant to the surface of the ingot as it emerges from the mould.

The edge baffle 4 comprises a continuous vertical wall 5 and a horizontal wall 6, which in normal operation rests on a gasket 7 on the top of the mould 1. The lower edge of the vertical wall 5 in operation extends downwardly to dip into the molten metal pool 8 in the ingot 9. The enclosed space between the edge baffle and the mould wall 2 is maintained full of inert gas (usually nitrogen and/or argon with or without admixed chlorine or other halogen) by passage of a slow gas stream and for this purpose gas inlet and outlet pipes 10, 11 are located in the horizontal wall 6. Lubricant is provided to the mould wall in any suitable manner; preferably in a conventional manner in the region of the gasket 7.

The molten metal is preferably supplied to the mould via a dip tube 12 and associated valve float 14 to maintain a substantially constant head of metal in the mould 2 during the casting operation.

The apparatus described may be subjected to various modifications. In particular the vertical wall 5 may be modified so as to slope inwardly, so that its inclination corresponds approximately to the inclination of the solid/liquid interface in the corresponding zone in the metal pool 8. Obviously the lower edge of the wall 5 must not extend so far as the solid/liquid interface. Where the wall 5 is inclined as described, it is possible to arrange for it to be very close to the mould wall at the level of the metal meniscus and in that way the wall 5 can be employed to exert more influence on the shape of the metal meniscus than it can where the wall 5 is essentially vertical.

The described apparatus has the advantage that it is possible to independently control the thickness of flux in the central region and enclosed peripheral region. In particular this allows a much lower thickness of flux to be employed in the enclosed region than in the central exposed region.

EXAMPLE 1

The apparatus of the invention has been used in the production of Al- lithium alloys in the form of 300 mm×125 mm ingots.

The alloys contain 1–3% Li by weight and usually contain 0.5–2.5% Cu and/or Mg in amounts up to 4%. The amount of Mg is commonly restricted to 0.2–1.0% when there is a substantial copper content.

In one particular casting operation the alloy was based on commercial purity aluminium with a 3% Li addition.

In another casting operation the composition of the alloy was: - Li 3.02%, Mg 0.63%, Cu 1.04%, Ti 0.002%, Zr 0.06%, Fe 0.15%, Si 0.09%, Al Balance.

Argon was used as the intert gas and was supplied at a rate of 10 liters/min. The baffle was constructed of mild steel and extended to a depth of about 6 mm into the molten metal. The space between the baffle wall and the mould wall was held at about 20 mm.

The baffle was protected from attack by liquid alloy by a plasma-sprayed coating of magnesium zirconate, on a nickel aluminide bonding coat. A liquid flux of lithium chloride was poured into the centre of the baffle during casting to isolate the exposed surface from the atmosphere. At the start of casting, and from time to time during casting the baffle was lifted to allow a small quantity of molten flux to run down over the meniscus at the metal/mould interface, to act as a cleansing agent.

Substantial improvements in the surface of the cast ingots of this type of alloy was achieved in this way.

As an alternative, small volumes of flux may be formed in situ between the edge baffle and the mould by the addition of a small percentage of chlorine in the inert gas. Reaction of the chlorine with the lithium-containing melt, forming LiCl, usually overcomes the need to periodically raise the baffle to clean the metal meniscus in the vicinity of the mould wall.

EXAMPLE 2

The invention has been used in the production of 300×125 mm D.C. ingots from alloys of the 7050 type.

Alloys of the 7050 type have been cast with and without the edge baffle in position. The compositions of the alloys are given in the table:

TABLE 1

| | | Zn | Mg | Cu | Zr | Ti | (Al/Fe/Si) |
|---|---|---|---|---|---|---|---|
| Ingot | 1 | 6.04 | 2.16 | 2.06 | 0.14 | 0.012 | Bal |
| " | 2 | 6.00 | 2.39 | 2.33 | 0.14 | 0.014 | " |
| " | 3 | 5.97 | 2.03 | 1.98 | 0.15 | 0.002 | " |
| " | 4 | 7.1 | 2.18 | 2.3 | 0.15 | 0.002 | " |
| " | 5 | 6.64 | 2.3 | 2.37 | 0.15 | 0.002 | " |
| " | 6 | 6.25 | 2.43 | 2.44 | 0.15 | 0.002 | " |

In each case Argon was used as the purging gas at a flow rate of 10 l/min.

In all cases ingot surfaces were improved by the use of the baffle and a considerable amount of oxide/dross built up at the baffle edge.

Approximate composition of ingot surfaces obtained from microanalysis in the scanning transmission electron microscope are given below:

TABLE 2

| Sample | Mode | Zn | Mg | Cu | Fe | Si | Zr | Al |
|---|---|---|---|---|---|---|---|---|
| Ingot 1 | Baffle OUT | 14 | 5 | 8 | 2.2 | 0.2 | 0.6 | 50 |
| | Baffle IN | 5 | 1 | 25 | 0.2 | 0.8 | ND | 72 |
| Ingot 2 | Baffle OUT | 19 | 22 | 8 | 27 | 1.5 | ND | 31 |
| | Baffle IN | 5 | 0.9 | 21 | 1.0 | 0.2 | ND | 72 |
| Ingot 3 | Baffle OUT | 40 | 45 | 9 | 7 | 2 | 0.2 | 36 |
| | Baffle IN | 7 | 0.6 | 29 | 0.9 | 0.4 | ND | 63 |

Clearly local segregational effects influence the analysis but there is a general trend for surfaces to be less rich in Mg, Zn, Fe and Si, but richer in Cu, when the edge baffle is used. This suggests an influence on oxidation reactions at the meniscus in addition to direct effects on surface segregation. It helps to explain the beneficial effect of protecting the metal meniscus from oxidation attack in the vicinity of the mould wall.

In these examples no specific attempt was made to control the meniscus shape by holding the edge baffle at a very close spacing in relation to the mould wall at the level of the meniscus.

The edge baffle of the invention can be removed very simply from the mould after each casting operation to allow the mould to be prepared for the commencement of the next casting operation. The metal within the open central region within the edge baffle may be protected by a cover flux and this arrangement permits supply of molten metal to the casting mould through a conventional dip tube and float valve or similar means.

It also provides room for a conventional glass cloth filter beneath a dip tube and float. This is particularly convenient since it is frequently necessary for the operator to adjust the position of the valve float during a casting operation. Such float also acts as a distributor for the metal entering the mould and is non-circular where the mould is non-circular, i.e. rectangular for production of a conventional rectangular rolling ingot.

I claim:

1. A method of casting an aluminium alloy which includes at least one readily oxidisable constituent and has a wide freezing range, which alloy is an aluminium-lithium alloy, which comprises casting the metal in an open-ended mould, maintaining the metal at a relatively uniform level in said mould during the casting operation, enclosing a space over the molten metal adjacent the mould wall by means of a baffle which dips into the molten metal at a position spaced away from the mould wall, maintaining said enclosed space full of an inert gas, establishing a body of an oxide-dissolving halide flux on the molten metal surface in the enclosed region, and maintaining the molten metal surface in the enclosed space at a level very close to the molten metal level in a central region within the baffle.

2. A method according to claim 1 further comprising maintaining said enclosed space at a predetermined pressure and passing a stream of said inert gas through said space.

3. A method according to claim 1 further comprising including a proportion of halogen gas in said inert gas stream for reaction with a component of said molten metal for in situ generation of an oxide-dissolving metal halide flux in said enclosed space.

4. A method according to claim 1 further comprising establishing a body of an oxide-dissolving halide flux on the molten metal surface in the central region lying inwardly of the baffle and raising said baffle one or more times out of contact with the molten metal surface to allow flux to flow outwardly over the surface of the molten metal in the peripheral region.

5. A method according to claim 1 further comprising controlling the shape of the metal meniscus at the molten metal/mould wall interface by maintaining a small predetermined superatmospheric or subatmospheric pressure in the space between the baffle and the mould wall.

6. A method according to claim 1, wherein the alloy contains 1 to 3% by weight of lithium.

7. A method according to claim 1, wherein the halide flux is formed in situ in the said enclosed space.

* * * * *